US006852971B2

(12) United States Patent
Baba et al.

(10) Patent No.: US 6,852,971 B2
(45) Date of Patent: Feb. 8, 2005

(54) ELECTRIC CHARGE ADJUSTING METHOD, DEVICE THEREFOR, AND MASS SPECTROMETER

(75) Inventors: Takashi Baba, Tokyo (JP); Yuichiro Hashimoto, Kokubunji (JP); Izumi Waki, Asaka (JP)

(73) Assignee: Hitachi, Ltd., Tokyo (JP)

( * ) Notice: Subject to any disclaimer, the term of this patent is extended or adjusted under 35 U.S.C. 154(b) by 0 days.

(21) Appl. No.: 10/320,606

(22) Filed: Dec. 17, 2002

(65) Prior Publication Data

US 2003/0160169 A1 Aug. 28, 2003

(30) Foreign Application Priority Data

Feb. 27, 2002 (JP) ..... P2002-050663

(51) Int. Cl.[7] ..... H01J 49/00

(52) U.S. Cl. ..... 250/292; 250/282; 250/291; 250/287

(58) Field of Search ..... 250/292, 282, 250/291, 287, 285

(56) References Cited

U.S. PATENT DOCUMENTS

| | | | | |
|---|---|---|---|---|
| 4,736,101 A | | 4/1988 | Syka et al. | |
| 4,755,670 A | | 7/1988 | Syka et al. | |
| 5,134,286 A | | 7/1992 | Kelley | |
| 5,783,824 A | | 7/1998 | Baba et al. | |
| 6,075,244 A | | 6/2000 | Baba et al. | |
| RE36,906 E | * | 10/2000 | Franzen | 250/292 |
| 6,483,109 B1 | * | 11/2002 | Reinhold et al. | 250/292 |
| 6,515,279 B1 | * | 2/2003 | Baykut | 250/285 |
| 2003/0089846 A1 | * | 5/2003 | Cooks et al. | |

FOREIGN PATENT DOCUMENTS

WO WO 01/15201 A2 8/2000

OTHER PUBLICATIONS

James L. Stephenson, Jr. and Scott A. McLuckey, "Ion/Ion Proton Transfer Reactions for Protein Mixture Analysis", Anal. Chem. (Nov. 15, 1996), vol. 68, pp. 4026–4032.

James L. Stephenson, Jr. and Scott A. McLuckey, "Adaptation of the Paul Trap for Study of the Reaction of Multiply Charged Cations with Singly Charged Anions", International Journal of Mass Spectrometry and Ion Processes (1997), pp. 89–106.

T. Gregory Schaeff, Benjamin J. Cargile, James L. Stephenson, Jr. and Scott A. McLuckey, "Ion Trap Collisional Activation of the $(M+2H)^{2+}$–$(M+17H)^{17+}$ Ions of Human Hemoglobin β–Chain", Analytical Chemistry, vol. 72. No. 5 (Mar. 1, 2000), pp. 899–907.

D. R. Denison, "Operating Parameters of a Quadrupole in a Grounded Cylindrical Housing", The Journal of Vacuum Science and Technology, vol. 8, No. 1, pp. 266–269.

B. A. Collings, J.M. Campbell, Dunmin Mao and D. J. Douglas, "A Combined Linear Ion Trap Time–of–Flight System with Improved Performance and $MS^n$ Capabilities", Rapid Communications in Mass Spectrometry (2001), vol. 15, pp. 1777–1795.

* cited by examiner

*Primary Examiner*—Nikita Wells
*Assistant Examiner*—Zia R. Hashmi
(74) *Attorney, Agent, or Firm*—Reed Smith LLP; Stanley P. Fisher, Esq.; Juan Carlos A. Marquez, Esq.

(57) ABSTRACT

In an electric charge adjusting method and mass spectrometer, tandem linear ion traps are employed such that charge-reducing reactions occur in only one of the linear ion traps. An ion reaching a given charge value is selectively moved to another linear ion trap. Through MS/MS mass analysis, the structure of a biomolecule is analyzed very efficiently with high sensitivity via a simple analysis.

18 Claims, 11 Drawing Sheets

ELECTRIC CHARGE ADJUSTING METHOD, DEVICE THEREFOR, AND MASS SPECTROMETER

BACKGROUND OF THE INVENTION

1. Field of the Invention

The present invention relates to a mass spectrometer wherein a sample solution is ionized by an atmospheric pressure ionization ion source such as ESI (Electro-Spray Ionization), a multi-charge ion produced in the ion source is introduced into a mass spectrometer, and a fragment ion is produced by Collision-Induced Dissociation (CID) or Infrared Multi Photon Absorption Dissociation (IRMPD) and mass analyzed.

Particularly, the present invention relates to a method and a mass spectrometer wherein charge reduction of the sample ion is carried out by using an ion having an opposite polarity with respect to the sample ion, and a mass spectrum of the fragment ion which tends to be complicated in a case of a multi-charged ion is simplified and analyzed with higher sensitivity.

2. Description of Related Art

A mass spectrometer is a device in which mass-to-charge ratio (m/z, where m represents the mass of the ions and z represents the charge of the ions) of sample ions is directly measured with high sensitivity and high precision. In recent years, the scope of its application has expanded to analyses of peptides and proteins. The analysis of those biomolecules is expected to be applied to various fields ranging from medical diagnosis to the design of drugs for treating new diseases.

Ion trap mass spectrometers are widely used in many fields because they can perform many functions in spite of being compact in size.

In recent years, mass analyses of peptides, proteins and DNA, etc. has become very popular, which is largely due to development of ionizing methods of the ion trap mass spectrometer. Typical such methods are Matrix Assisted Laser Desorption Ionization (MALDI) and Electrospray Ionization (ESI).

MALDI is an ionization method mainly for generating single-charge ions when ionizing proteins, and it is compatible with Time of Flight (TOF) mass spectrometry. In ESI, biomolecules become multi-charge ions, which are ions wherein one molecule (mass: m) has multiple charges (number of charges: n). Because mass spectrometers analyze mass-to-charge ratio (m/z), each multi-charge ion is identified by its mass-to-charge ratio of m/n.

Multi Stage Mass Spectrometry (MS/MS) is a method which determines the structure of a biomolecule ion produced by the above ionization method using a mass analysis. Parent ions are dissociated by methods such as CID and IRMPD. A pattern of the fragment ion is determined by a mass spectrometer so that the structure of the parent ion is determined.

In many cases of analysis, the required sensitivity is less than a picogram (pg=$10^{-12}$ g). Compared to the component to be analyzed, there are many disturbing components which can cause problems. Therefore, reduction of the disturbance or noise is essential. This noise is called chemical noise. The charged particles which give substantially the same m/z as that of the sample ions to be analyzed become chemical noise during actual analysis. Such chemical noise might comprise an ion having a lighter mass and a smaller number of charges or a heavy cluster having many charges.

One way to discriminate between chemical noise and a component to be analyzed comprises a method of charge reduction as shown in Analytical Chemistry vol. 68 (1996), page 4026 and Internal Journal of Mass Spectrometry and Ion Processes Vol. 162 (1997) 89. A mass spectrometer comprises an ion trap, which has a fluorocarbon negative ion source by glow discharge. A positive sample ion produced in an ESI ion source is trapped in an ion trap mass spectrometer and, further, a negative ion is introduced there. Both ions are captured by the ion trap and attract each other by attracting Coulomb force.

The m/z of a multi-charge ion whose charge is reduced by the ion-ion reaction becomes greater compared to the m/z before the ion-ion reaction. Since the change in the value of m/z of the ion to be analyzed by the ion-ion reaction can be clearly distinguished from that of a chemical noise, it is possible to eliminate the chemical noise.

On the other hand, it is proposed in Analytical Chemistry, Vol. 72, p. 899 (2000), that charge reduction by the ion-ion reaction be used to simplify a spectrum of a multi-charged fragment ion produced after the MS/MS analysis. Because of the charge reduction by the ion-ion reaction, the number of candidates of m/z values based on the same mass m is reduced. Therefore, it becomes easier to analyze the spectrum. Further, discrimination between a multi-charged ion having greater mass and a chemical noise in the smaller mass region becomes simple.

In the prior art, chemical noises are eliminated and an analysis of a spectrum is made easier by charge reduction. However, since a reaction of a sample ion and an oppositely charged ion is stochastic, charge reduction continues until the number of charges, of the sample ion becomes zero, or the sample ion becomes neutral. In this case, the sample ion escapes from the ion trap and, as a result, analysis sensitivity is degraded.

SUMMARY OF THE INVENTION

The present invention provides a mass spectrometer comprising a mechanism to stop a charge-reducing reaction with respect to an ion having reached a given value of electric charge by the charge-reducing reaction. According to a preferred aspect, the mass spectrometer of the present invention spatially and selectively separates the sample ions having the desired charge from the opposite charged ions for stopping the charge-reducing reaction.

In carrying out the invention, a preferable embodiment of the mass spectrometer comprises: at least two ion traps are arranged in series; one of those ion traps accompanied with an ion source for introducing opposite-charge ions with respect to sample ions; and a power supply applying an AC voltage to move the ions from one ion trap to the another ion trap.

In particular, linear ion traps are useful for this purpose because the potential between them is easily controlled.

The charge-reduced ions are used as parent ions for Multi-Stage Mass Spectrometry (MS/MS). This MS/MS analysis may be performed in another ion trap where the charge-reduced ions are introduced, or may be performed in the original trap. Particularly, when the analysis is performed in the original ion trap, the same power supply can serve both as an AC power supply for charge adjustment and as a power supply for analysis.

For identifying fragment ions in MS/MS analysis, the second mass analysis is performed by using one of the ion traps, or a mass spectrometer, which is connected to the charge-reducing device, such as a Paul trap ion trap mass spectrometer, a TOF mass spectrometer or a magnetic sector mass spectrometer.

According to the present invention, multiple-charged ions of biomolecules can be converted into ions with desired charge. By performing an MS/MS mass analysis on the ion converted to have the given charge, structure of the biomolecule can be analyzed highly efficiently.

The details of the invention will appear in the following embodiments.

BRIEF DESCRIPTION OF THE DRAWINGS

For the present invention to be clearly understood and readily practiced, the present invention will be described in conjunction with the following figures, wherein like reference characters designate the same or similar elements, which figures are incorporated into and constitute a part of the specification, wherein.

DETAILED DESCRIPTION OF THE INVENTION

It is to be understood that the figures and descriptions of the present invention have been simplified to illustrate elements that are relevant for a clear understanding of the present invention, while eliminating, for purposes of clarity, other elements that may be well known. Those of ordinary skill in the art will recognize that other elements are desirable and/or required in order to implement the present invention. However, because such elements are well known in the art, and because they do not facilitate a better understanding of the present invention, a discussion of such elements is not provided herein. The detailed description will be provided herein below with reference to the attached drawings.

Preferred embodiments of the present invention are described below. For the sake of convenience, the polarity of sample ions is assumed to be positive and the polarity of an oppositely charged ion is assumed to be negative. When the polarity of the sample ions is negative, it is assumed that the polarity of an oppositely charged ion is positive and that the operation proceeds by altering the polarity of the applied electrostatic voltage. Alternatively, it is possible to set the value of the controlled charge number and adjust the produced ion to have a single charge (n=1) so as to relate to a MALDI ion source where single-charge ions are apt to be produced.

Figure 1:
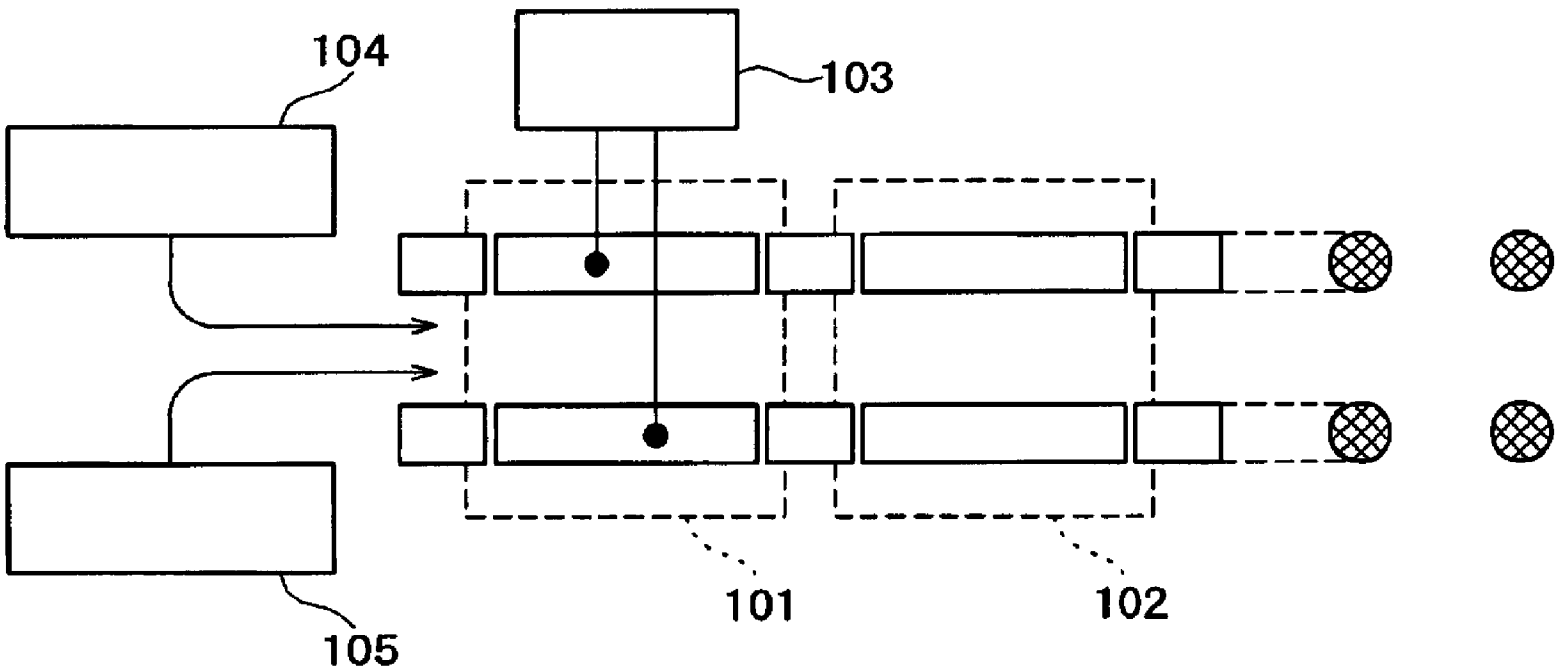
FIG. 1 is a schematic diagram of a preferred mass spectrometer of the present invention.
Figure 2:
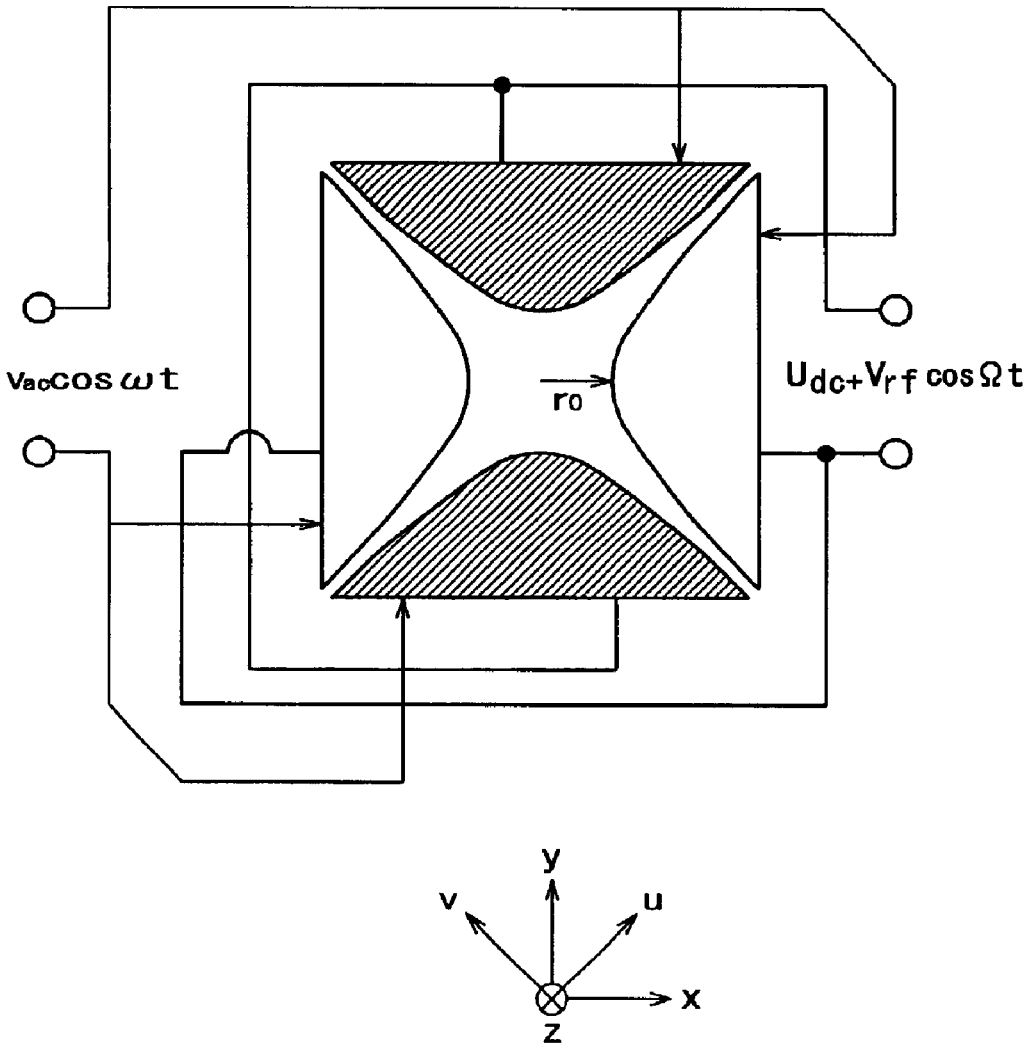
FIG. 2 PRIOR ART
FIG. 2 illustrates a preferred method of applying a voltage in a linear ion trap comprising hyperbolic electrodes according to the present invention.
Figure 3:
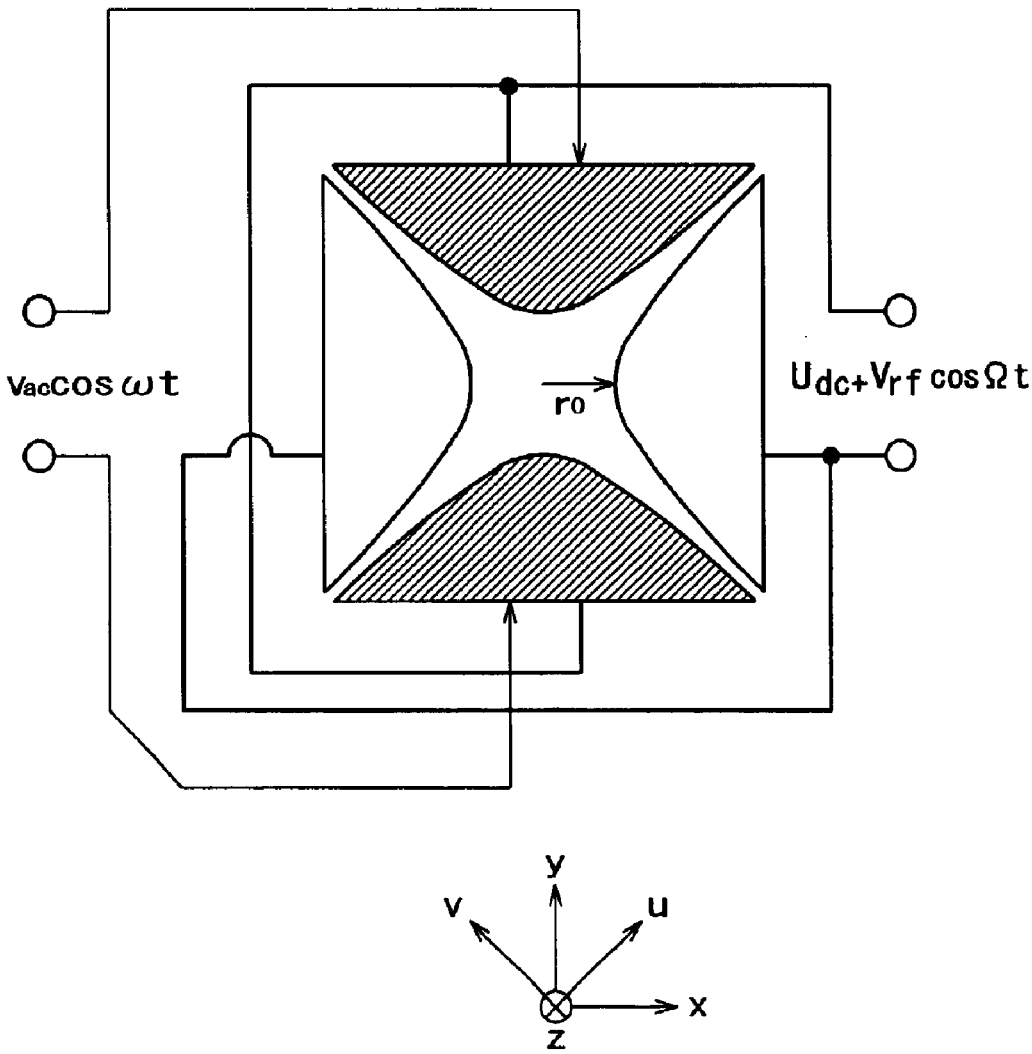
FIG. 3 PRIOR ART
FIG. 3 illustrates another preferred method of applying a voltage in a linear ion trap comprising hyperbolic electrodes according to the present invention.

First, the principle of operation of a preferable linear ion trap of the present invention is described below. An ideal linear quadrupole ion trap electric field, which has infinite length and a hyperbolic section, can be generated by applying a high-frequency voltage having a frequency O and an amplitude Vrf, and a static voltage Udc, as shown in FIGS. 2 and 3. The quadrupole electric field generated in the electrode is given by equation 1:

$$\phi(x, y, z) = -\frac{x^2 - y^2}{2r_0^2}(V_{rf}\cos\Omega t + U_{dc}) \tag{1}$$

In this electric field, the equation of motion of an ion having mass (m) and charge (z=ne) is described as follows:

$$m\frac{d^2}{dt^2}\begin{bmatrix} x \\ y \end{bmatrix} = -z\ grad\ \phi(x, y, z) \tag{2}$$

This equation of motion is identical to the Mathieu equation in both the directions of x and y as follows:

$$\frac{d^2}{dt^2}u + (a - 2q\cos 2\xi)u = 0 \tag{3}$$

In the above equation, u=x, y, $\xi=\Omega t/2$, and two parameters a and q are given by equations 4 and 5.

$$a = \pm\frac{4zU_{dc}}{mr_0^2\Omega^2} \tag{4}$$

$$q = \frac{2zV_{rf}}{mr_0^2\Omega^2} \tag{5}$$

Figure 6:
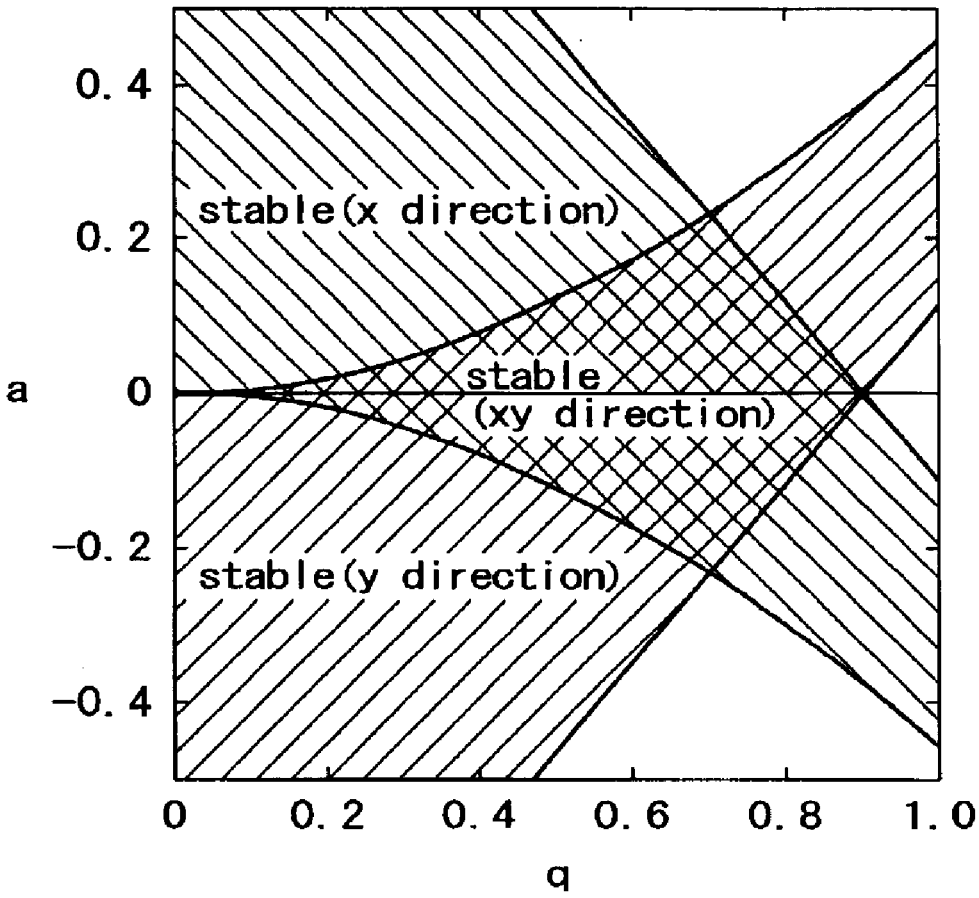
FIG. 6 shows a stable region of a preferred linear ion trap of the present invention.

Using these two parameters, stable conditions can be maintained in the ion trap. The stability diagram is shown in FIG. 6.

The ion stored in the ion trap has a harmonic oscillation mode called a secular motion. Its frequency, called the secular frequency ω, can be approximately given by the equation 6.

$$\omega = \frac{\Omega}{2\sqrt{2}}q \tag{6}$$

Since the secular frequency is inversely proportional to the mass-to-charge ratio (m/z), the mass analysis can be performed by measuring the secular frequency of the trapped ion. Several methods are known for measuring the secular frequency. The most popular way is resonant oscillation by an external AC electric field, where the excited ions are ejected outside the ion trap and detected by an ion detector. The method for a Paul trap is disclosed in U.S. Pat. No. 4,736,101 and a method for a linear ion trap is disclosed in U.S. Pat. No. 4,755,670. Further, the resonant oscillation method is useful for eliminating unwanted ions trapped in the ion trap. The ion eliminating principle using a Paul trap based on the above principle is disclosed in U.S. Pat. No. 5,134,286. In preferred embodiments of the present invention, such mass analysis method and method of elimination preferably may be adopted as required.

In the linear ion trap, as a method for mass analysis and elimination, a method is disclosed in U.S. Pat. No. 5,783,824 which is based on a principle wherein an electrostatic potential applied in the direction of the z axis, or in the direction in which high frequency is not applied, is regarded as a harmonic type, and a harmonic frequency according to such a potential is excited. Preferably, such method may be adopted in the present invention as required.

Figure 4:
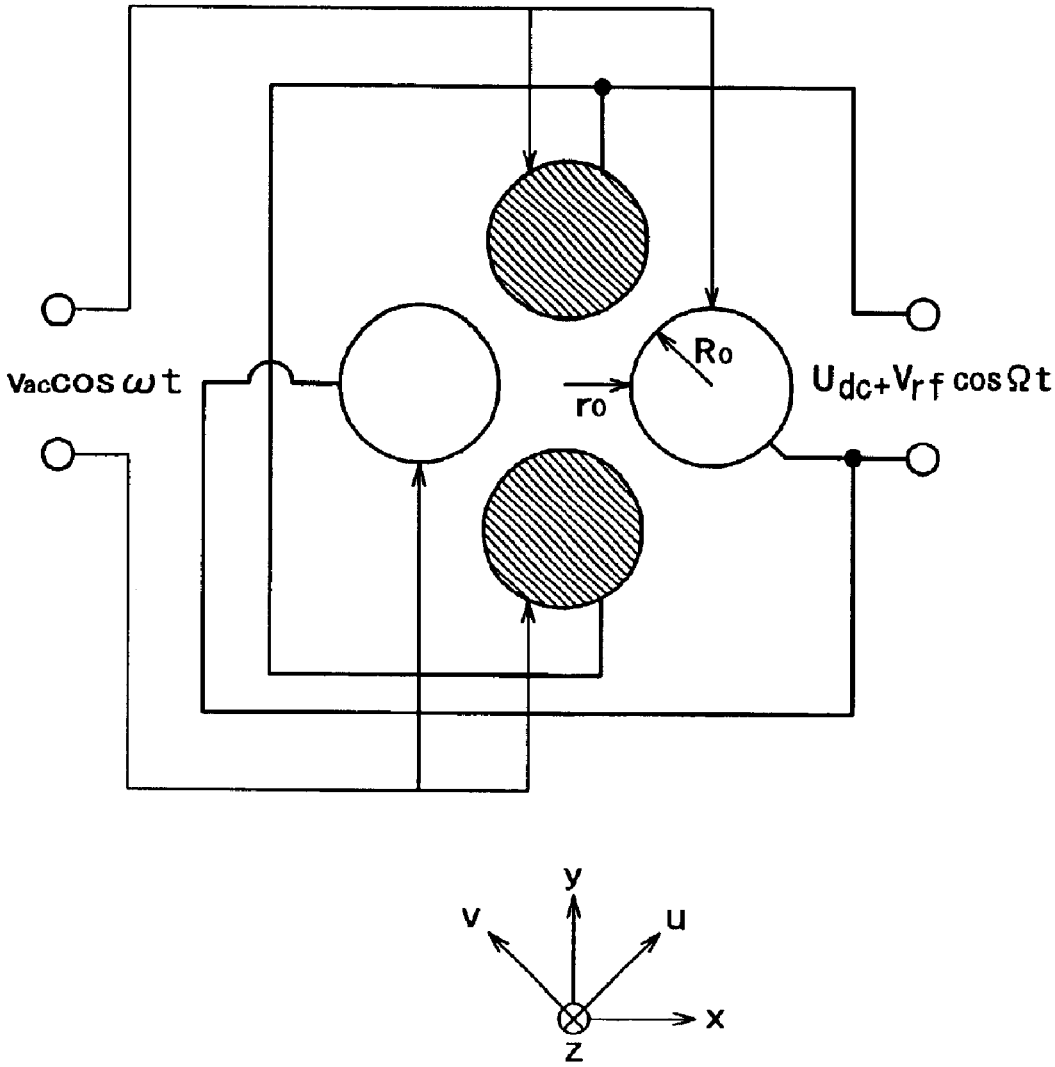
FIG. 4 PRIOR ART
FIG. 4 illustrates a preferred method of applying a voltage in a linear ion trap comprising cylindrical electrodes according to the present invention.
Figure 5:
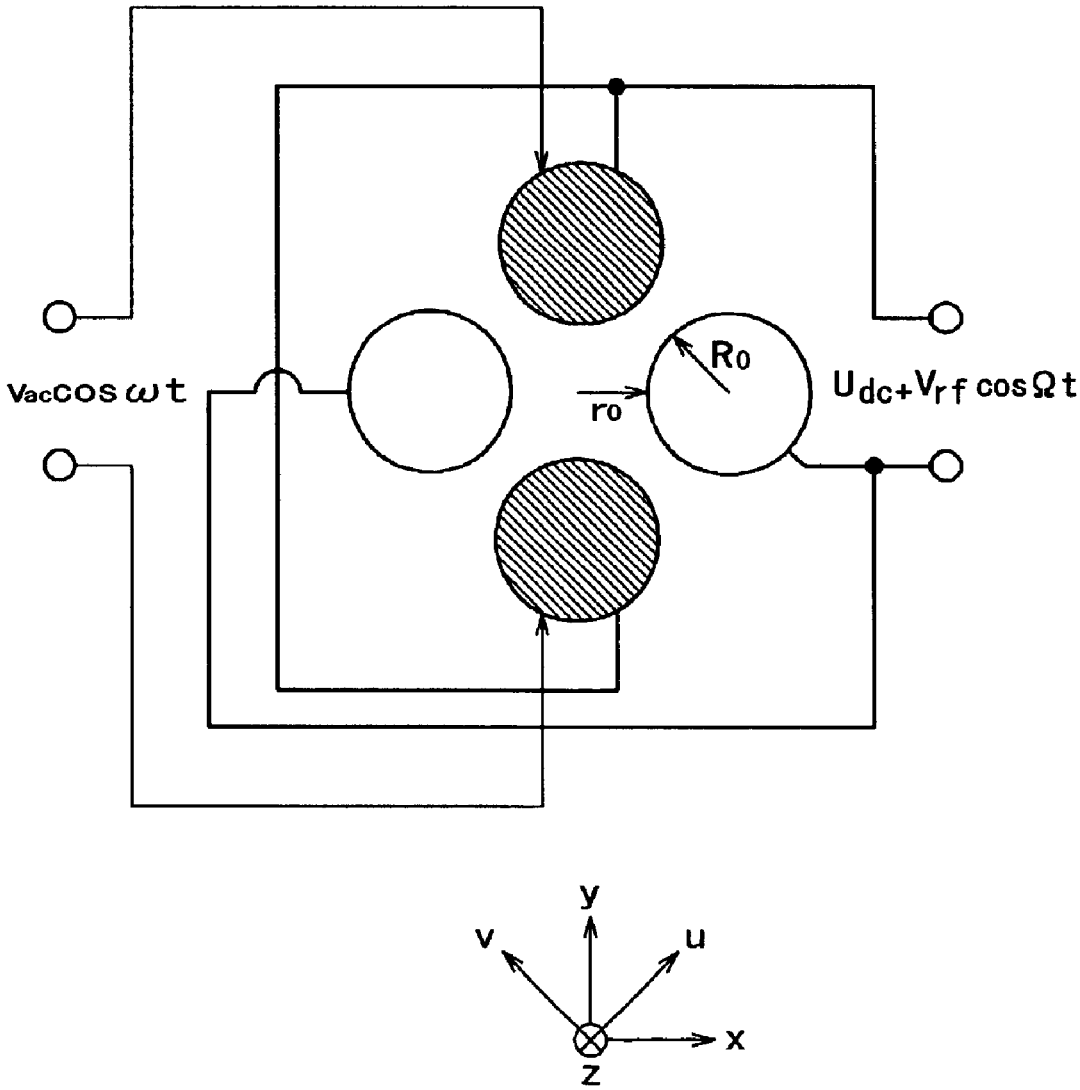
FIG. 5 PRIOR ART
FIG. 5 illustrates another preferred method of applying a voltage in a linear ion trap comprising cylindrical electrodes according to the present invention.

In the description so far and in FIGS. 2 and 3, the description was in reference to an electrode having an ideal quadrupole structure. However, it is difficult to make an ideal quadrupole structure. Therefore, in D. R. Dennison, Journal of Vacuum Science and Technology, 8 (1971) 266, a method is shown related to the electrode size wherein four cylindrical electrodes are combined to approximately generate a quadrupole electric field in the center of the ion trap (See FIGS. 4 and 5). According to this study, the relationship between a radius $R_0$ of the cylindrical electrode and a distance $r_0$ from the center of the quadrupole to the electrode is given by equation 7.

$$R_0=1.147r_0 \quad (7)$$

The characteristic of the linear ion trap is that since its both ends are physically open, a plurality of linear ion traps can be arranged in series. By applying a given electrostatic voltage between the electrodes, it is possible to control the movement of the ions. Since transverse directions (x, y direction) are bound by a high frequency, transport efficiency between ion traps can be high. A series of inventions are disclosed in U.S. Pat. No. 6,075,244 wherein linear ion traps are arranged in series to achieve various ion manipulations and to improve accuracy and sensitivity of mass analysis. Preferably, such method may also be adopted in the present invention as required.

First Preferred Embodiment

Figure 9:
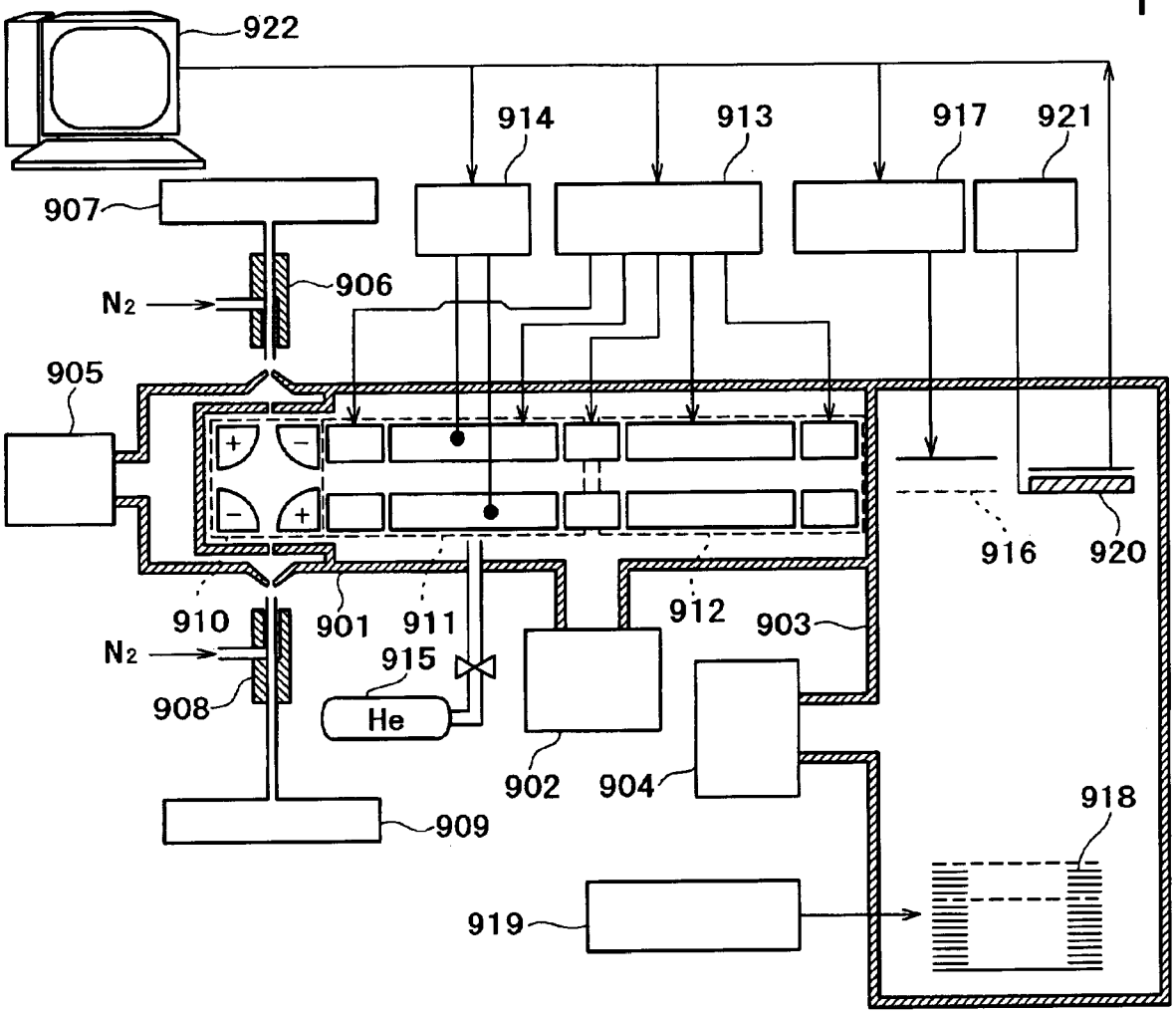
FIG. 9 illustrates a linear ion trap-Time of Flight mass spectrometer comprising a preferred charge-reducing device of the present invention.

FIG. 9 shows amass spectrometer with a charge-reducing device, which comprises a quadrupole deflector 910, a tandem linear trap 911 and 912, a sample ion source 908 and 909 and an opposite-charge ion source 906 and 907, and an AC power supply 914, and a TOF mass spectrometer 916–920. The fragment ion is guided into a Time of Flight mass spectrograph (TOF mass spectrometer), and is mass analyzed with high mass resolution. Examples of the study by combining a linear ion trap and a TOF mass spectrograph in the present preferred embodiment are disclosed in B. A. Collings, et. al., Rapid Communications in Mass Spectrometry 2001;25;1777 and so on.

The preferred charge-reducing device of the present embodiment uses a tandem linear ion trap 911 comprising a quadrupole deflector 910. The ion trap on the quadrupole deflector side is connected to an AC power supply 914 for generating a dipole electric field for exciting the ions. A sample ion source 908 and 909, and a negative ion source 906 and 907, are connected to the quadrupole deflector 910. By using the quadrupole deflector, it becomes possible to introduce an ion having both polarities into the linear ion trap with high efficiency.

Figure 7:
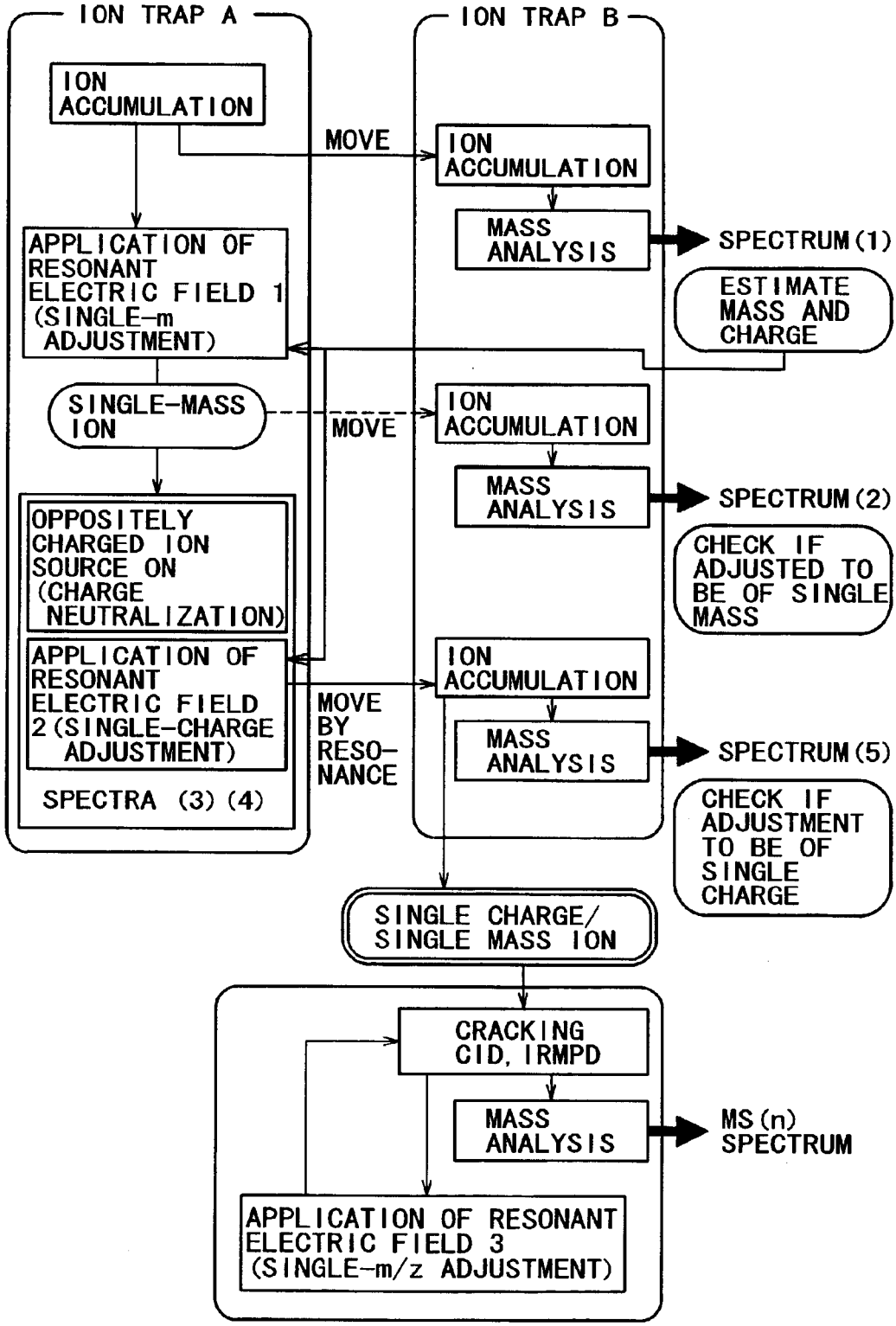
FIG. 7 illustrates a preferred operating procedure of the present invention.
Figure 8:
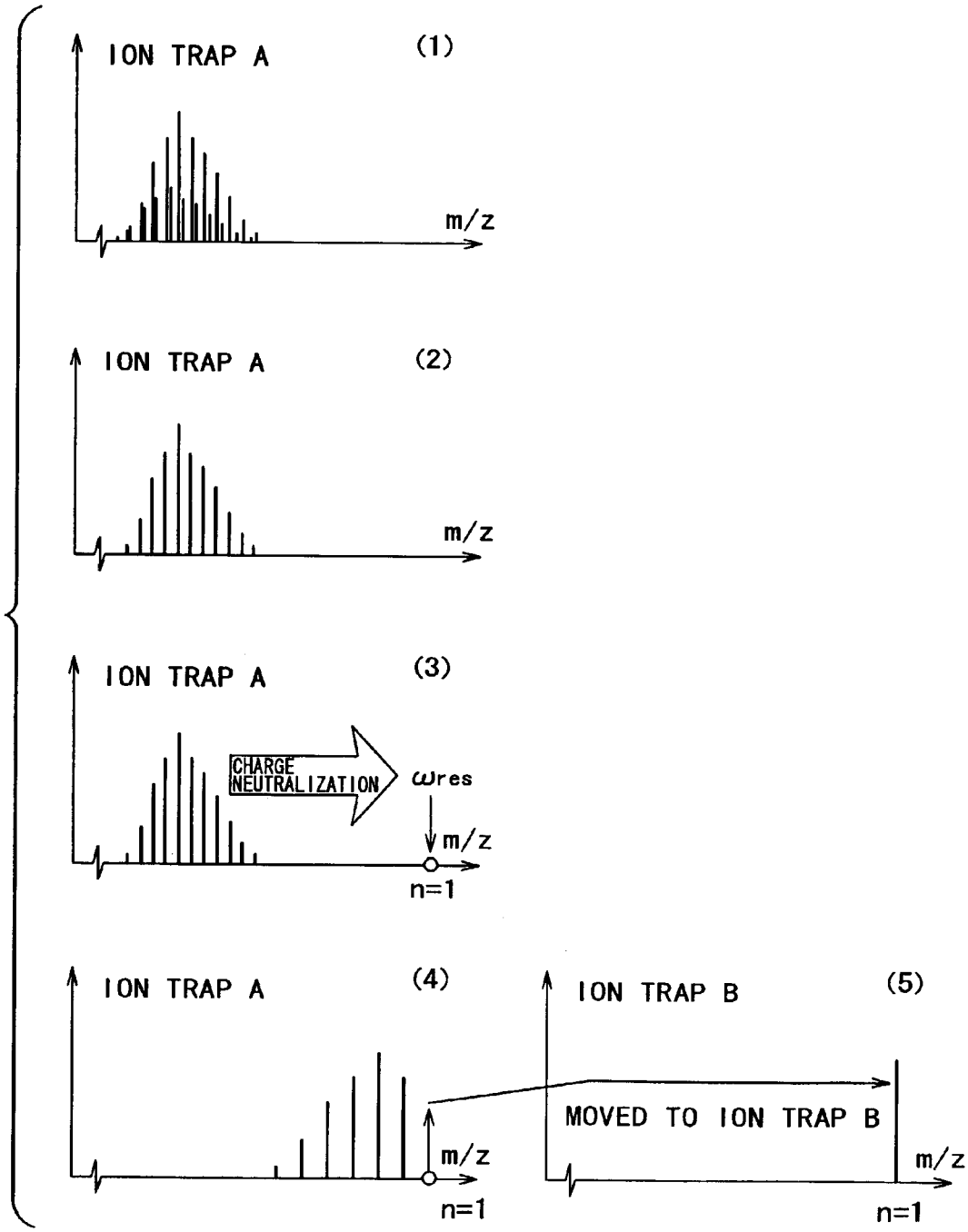
FIG. 8 illustrates the details about a mass spectrum obtained by a preferred operating procedure of the present invention.

The operation of the first preferred embodiment is described below in time sequence, including the principle of charge reduction of the present invention. As shown in FIGS. 7 and 8, the operation of the first preferred embodiment comprises the steps of: (1) estimating mass and charge of a sample ion, (2) eliminating unwanted ions as required, (3) reducing charge, and (4) transferring the ion whose charge is controlled. In the mass analysis operation for examining the ions at each operational step, the ions are transferred into the linear ion trap beside of the TOF mass spectrometer, and then the ion is sent into the TOF mass spectrometer.

Production of Sample Ion

Figure 10:
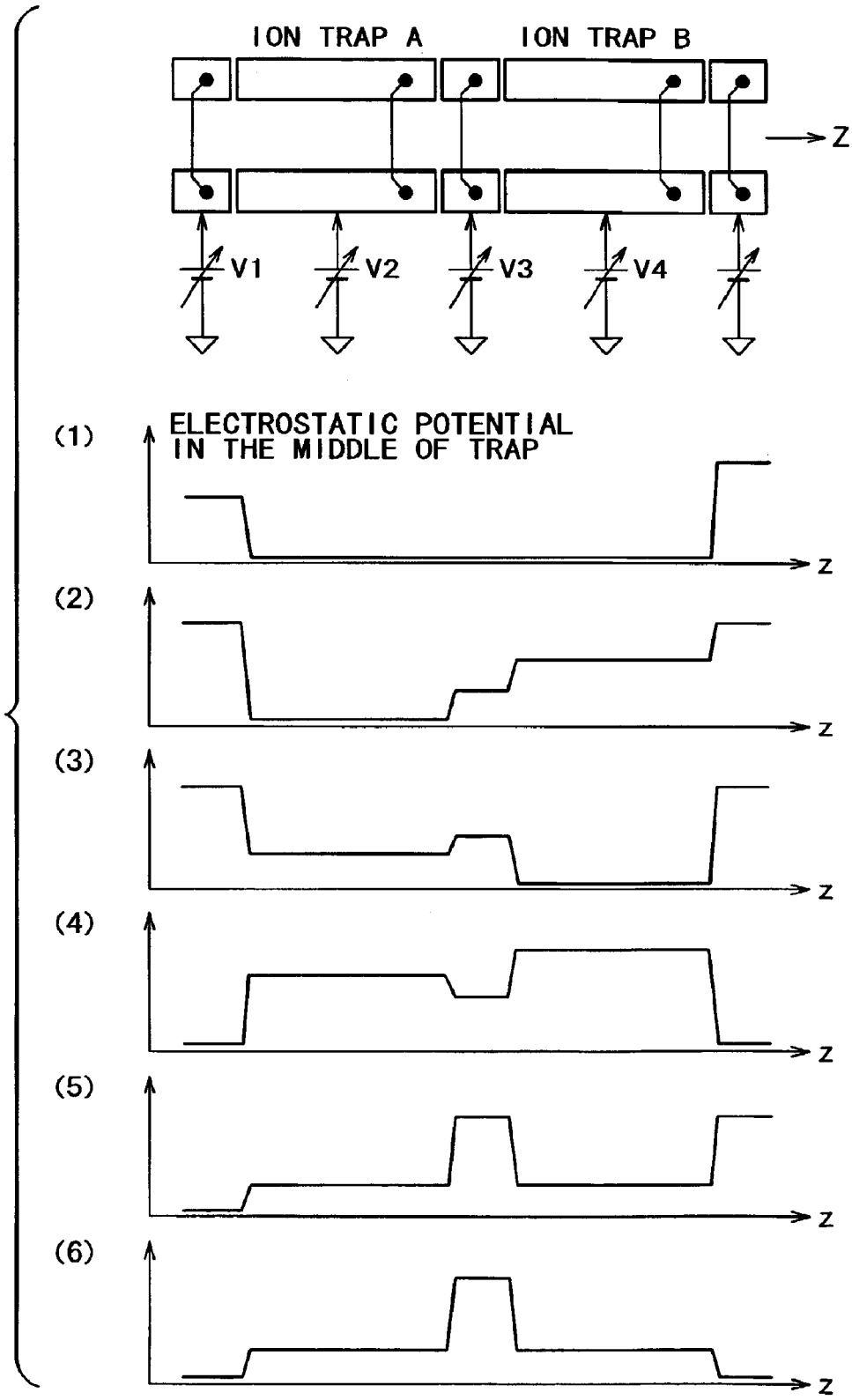
FIG. 10 illustrates the details about a positive voltage to be applied to a linear ion trap in a preferred operating procedure of the present invention.

The sample ion with positive charge generated by using ESI ion source 908 and 909 is introduced into the ion trap by the quadruple deflector 910. At this time, an electrostatic potential of the tandem linear ion traps is set as shown in FIG. 10(1). Preferably, the potential wall is made high on the side of a TOF to prevent the incident ion from reaching the TOF and being lost. The chamber in which the linear ion traps are placed is filled with a helium gas of about 1 m Torr. The incident ions lose kinetic energy by collision with the helium gas and are accumulated in the linear ion traps. At this time, as seen in FIG. 10(1), the voltage wall between the two linear ion traps is made low. The purpose of this is to make the ion lose more kinetic energy before it comes back to the entrance.

After the period of accumulating ions, the electrostatic potential of the tandem linear ion traps is set as shown in FIG. 10(2) and then in FIG. 10(3). Thus, the trapped ions can be collected in an ion trap A.

(1) Estimation of Mass and Charge

The charge-reducing operation is started by estimating mass and charge of a sample ion. In order to do so, the sample ion first is mass analyzed. In the present preferred embodiment, a TOF mass spectrometer is used. A diagram of a spectrum is shown in FIG. 8(1).

In a case of a multi-charge ion, its m/z value is given by m/n. A unit charge e here is set to one. According to a peak position ($m_n$) and an adjacent peak ($m_{n-1}$), n and m can be estimated by the following calculation. When we assume that $m_n=m/n$ and $m_{n-1}=m/(n-1)$, n and m are obtained as $n=m_{n-1}/(m_{n-1}-m_n)$ and $m=nm_n$. Accuracy of m and n can be improved by performing such calculations with respect to a plurality of peaks.

When a sample ion having two or more kinds of masses is introduced, a plurality of distributions are superimposed. FIG. 8(1) is a diagram showing that an ion having two kinds of masses is trapped. In this case, the adjacent peaks do not have the same m. However, in general, it can be assumed that an abundance with respect to n becomes substantially a Poisson distribution. Therefore, it is possible to separate m of different kinds of ions.

This estimation is made at least once before carrying out the charge reduction of the present invention. After that, the same condition is reused, or an estimation is made again as required.

(2) Purification of the Target Parent Ions

When a plurality of m's are included, unwanted ions are eliminated as required. An elimination is carried out by referring to the spectrum measured in step (1) above and applying the same secular frequency of unwanted ions to eliminate the unwanted ions by resonance excitation (FIG. 8(2)).

(3) Charge Reduction

Now, a preferred method of the present invention for moving an ion having a specific secular frequency from one linear ion trap to another linear ion trap is described below. In this preferred embodiment, the charge, n, is set to one.

The ion is moved to an ion trap A in advance. Using the result of estimated m in step (1), a secular frequency of the ion with a single charge is calculated according to equation 6 above. An AC electric field having the same frequency or an AC electric field having a frequency band including that frequency is applied to the ion trap A (FIG. 8(3)). A negative ion is prevented from entering the trap B by setting the depth of the ion trap B deeper than that of the ion trap A (FIG. 10(3)). The ion transferred into the ion trap B is thereby also prevented from returning to the ion trap A. Now, for a charge reduction, the negative ion source is operated. By using a quadrupole deflector and an ion source, an opposite-charge ion is introduced into the ion trap with high efficiency. To negative ions, the electrostatic potential in the ion trap A is a barrier (FIG. 10(4)). Therefore, it is necessary to give a negative ion enough kinetic energy to overcome such potential. The kinetic energy of the ion which has overcome this potential becomes small. Therefore, the cross-section and collision probability of an ion-ion reaction are increased. Also, to the negative ion, the potential of the ion B is set higher than a potential of the ion trap A and kinetic energy of the negative ion. According to this set up, the negative ion is prevented from reaching the ion trap B, i.e., the ion-ion reaction does not take place in the ion trap B.

An AC electric field is applied to the ion trap A, which has a frequency of a secular motion of singly-charged ions, or an AC electric field having a frequency band including that frequency. Therefore, ions having reached the desired charge (in this case: n=1) start a resonance oscillation by the AC electric field. Since the kinetic energy of the ion is elevated by the resonance oscillation, the ions get over the potential barrier between the ion trap A and the ion trap B, and are transferred to the ion trap B. As no negative ion exists in the ion trap B, no further charge reduction occurs due to the ion-ion reaction taking place.

The ion transfer method between ion traps preferably adopted in the present invention is the one referred to in PCT: W001/15201A2. An MS/MS analysis is performed by using a biomolecular ion whose charges are adjusted by charge reduction. A spectrum is obtained which is similar to a MALDI case, but which is easy to analyze. In ESI, since samples can be introduced in flow sequence, its throughput is higher than that of MALDI.

Next, an example of an MS/MS operation using a linear ion trap is described below. First, an ion is introduced into the linear ion trap A. The q value of a charge-adjusted parent ion is set at about 0.1, which makes it possible to store both the parent ion and an ion produced by cracking the parent ion in the ion trap. An AC voltage is applied to start a resonance oscillation of the ion. The ion is collision induced dissociated (CID) by the collision with a helium gas filled in the ion trap, and cracked. The fragment ion is transferred into the ion trap B (FIG. 10(5)), and further introduced into a TOF mass spectrometer, where a mass analysis with high mass resolution is performed (FIG. 10(6)).

Second Preferred Embodiment

Figure 11:
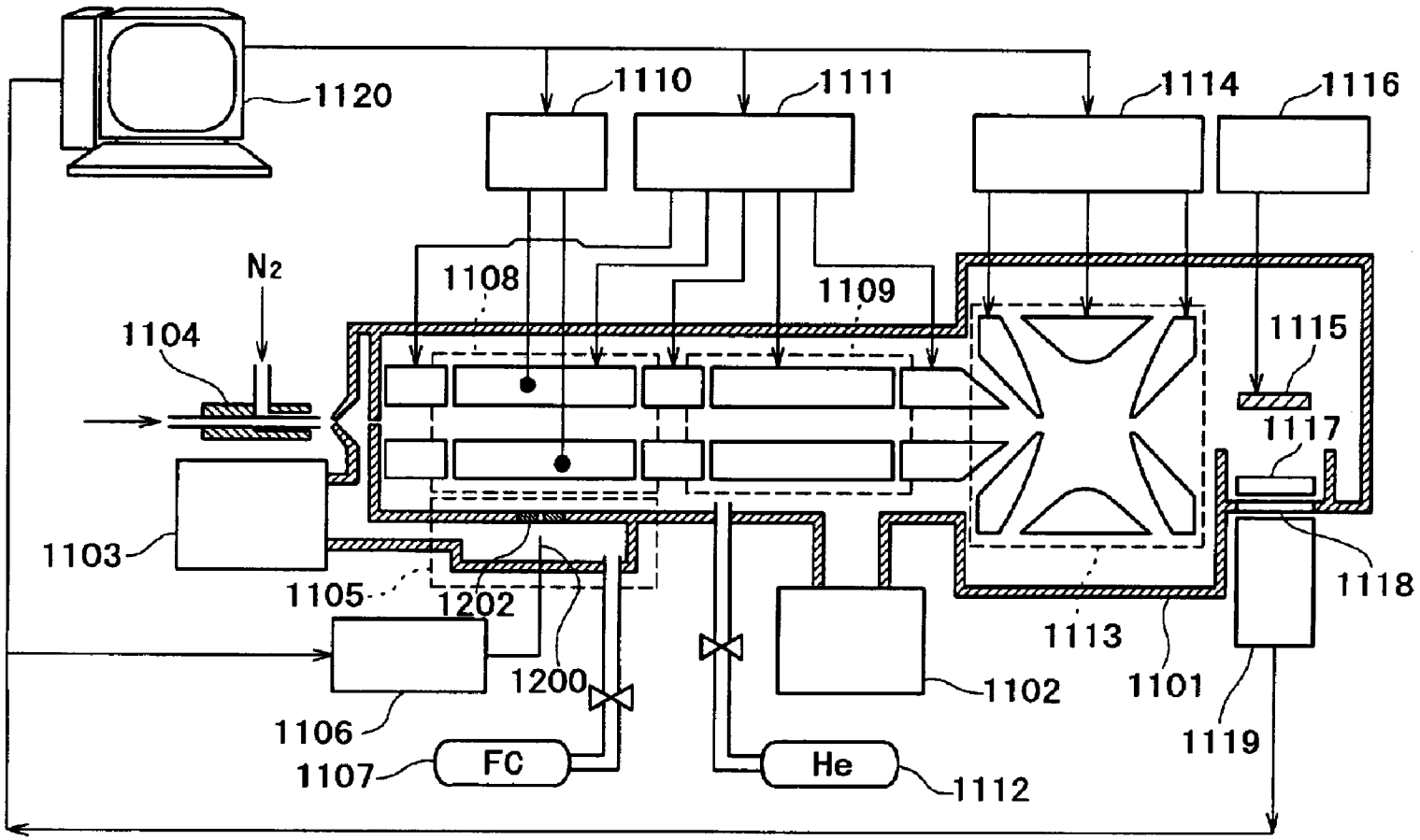
FIG. 11 illustrates a Paul-type linear ion trap mass spectrometer comprising a preferred charge-reducing device of the present invention.

FIG. 11 shows a charge-reducing device provided with a negative ion source using a glow discharge on the side of a linear ion trap. The ion generated there is then introduced into an ion trap mass spectrometer of the Paul trap type with high mass resolution, and an MS/MS mass analysis is performed in the mass spectrometer. Compared to a TOF mass spectrometer, a Paul trap mass spectrometer is compact and economically produced.

The linear ion trap is basically structured according to the same principle as in preferred Embodiment 1. In the present preferred embodiment, in order to place the linear ion trap close to a hole of a Paul trap end cap, an electrode end is formed in accordance with the shape of the end cap and positioned, as shown in FIG. 11.

Negative ions are introduced through the gap of the linear ion trap. Accordingly, the quadrupole deflector can be omitted, which makes it possible to manufacture the device economically. However, because negative ions are slowed and captured due to the viscosity of the gas filled in the ion trap, the capture rate is somewhat lower than that of the quadrupole deflector.

The negative ion source using the glow discharge is configured as follows: First, a fluorocarbon gas supplied from a gas cylinder 1107 is sent to the glow discharge ion source 1105. A negative high-voltage power supply 1106 is connected to the discharge electrode 1200, and a current to maintain the glow discharge is supplied. A negative voltage is usually applied to the gate electrode 1202, and the ions cannot pass through the hole of this electrode. When introducing an ion, its potential is lowered to the ground potential. Accordingly, the negative ion can pass through the hole, and the ion is emitted through the hole of the ion gate electrode into the gap of the linear ion trap 1108 (ion trap A). The speed of the incident ion is slowed by the helium gas filled in the ion trap. The slowed negative ion and a positive sample ion attract each other by Coulomb force and they cause an ion-ion reaction. The operation of the charge reduction is the same as in preferred Embodiment 1.

The method of performing an MS/MS analysis by the Paul trap mass spectrometer is widely known. The point to be noted when applying it to the present invention is that chemical noises, such as liquid drips, generated in the sample ion source hit an ion detector of the Paul trap mass spectrometer and become background noises. In order to avoid this, the ion detector preferably is positioned to keep away from a line connecting two holes of the Paul trap end caps. In the preferred Embodiment 2, one of the conversion dynodes 1115 is displaced from the above line and negative high voltages are applied independently. A secondary electron is generated there from the incident ion. Having this electron enter a scintillator 1118, fluorescence generated there is detected by a photomultiplier 1119.

The foregoing invention has been described in terms of preferred embodiments. However, those skilled, in the art will recognize that many variations of such embodiments exist. Such variations are intended to be within the scope of the invention and the appended claims.

Nothing in the above description is meant to limit the present invention to any specific materials, geometry, or orientation of elements. Many part/orientation substitutions are contemplated within the scope of the present invention and will be apparent to those skilled in the art. The embodiments described herein were presented by way of example only and should not be used to limit the scope of the invention.

Although the invention has been described in terms of particular embodiments in an application, one of ordinary skill in the art, in light of the teachings herein, can generate additional embodiments and modifications without departing from the spirit of, or exceeding the scope of, the claimed invention. Accordingly, it is understood that the drawings and the descriptions herein are proffered by way of example only to facilitate comprehension of the invention and should not be construed to limit the scope thereof.

What is claimed is:

1. A charge-reducing device comprising:

a sample ion source which generates multiple-charged sample ions;

first and second linear ion traps arranged in series;

an AC power supply system which supplies a dipole AC electric field to said first linear ion trap;

an opposite-charged ion source which generates opposite-charged ions with respect to said multiple-charged sample ions;

wherein said multiple-charged sample ions are introduced into said first and second linear ion traps, and said multiple-charged sample ions in said first and second linear ion traps lose kinetic energy by collision with a gas filling said first and second linear ion traps;

wherein said multiple-charged sample ions in said second linear ion traps are transferred to said first linear ion trap; and wherein said opposite-charged ions are introduced into said first linear ion trap upon condition that, to said opposite-charged ions, an electrostatic potential of said second linear ion trap is set higher than an electrostatic potential of said first linear ion trap such that said opposite-charged ions are not introduced into said second linear ion trap and a charge-reducing reaction between said opposite-charged ions and said multiple-charged sample ions takes place in said first linear ion trap and said charge-reducing reaction does not take place in said second linear ion trap, and upon condition that said dipole AC electric field, having a frequency of a secular motion of charge-reduced ions by said charge-reducing reaction or having a frequency band including a frequency of a secular motion of said charge-reduced ions, is applied to said first linear ion trap by said AC power supply system such that said charge-reduced ions excited selectively by said dipole AC electric field are selectively transferred to said second linear ion trap from said first linear ion trap.

2. A charge-reducing device according to claim 1, further comprising:

a quadrupole deflector which deflects ions by a polarity of ions and introduces separately said multiple-charged sample ions and said opposite-charged ions at different timing, wherein, at first timing, said multiple-charged sample ions are introduced into said first and second linear ion traps through said quadrupole deflector; and wherein, at second timing, said opposite-charged ions are introduced into said first linear ion trap through said quadrupole deflector.

3. A charge-reducing method comprising the steps of:

generating multiple-charged sample ions;

introducing and accumulating said multiple-charged sample ions into a first linear ion trap;

transferring said multiple-charged sample ions accumulated in said first linear ion trap to a second linear ion trap, said first and second linear ion traps being arranged in series;

measuring a mass spectrum of said multiple-charged sample ions accumulated in said second linear ion trap;

estimating a mass and charge of said multiple-charged sample ions, based on said mass spectrum;

transferring said multiple-charged sample ions in said second linear ion trap to said first linear ion trap;

generating opposite-charged ions with respect to said multiple-charged sample ions and introducing said multiple-charged sample ions into said first linear ion trap;

causing a charge-reducing reaction between said opposite-charged ions and said multiple-charged sample ions in said first ion trap to obtain charge-reduced ions; and exciting said charge-reduced ions selectively by a dipole AC electric field applied to said first linear ion and transferring said charge-reduced ions excited selectively to said second linear ion trap;

wherein said opposite-charged ions are introduced into said first linear ion trap upon condition that, to said opposite-charged ions, an electrostatic potential of said second linear ion trap is set higher than an electrostatic potential of said first linear ion trap such that said opposite-charged ions are not introduced into said second linear ion trap and said charge-reduction takes place in said first linear ion trap an said charge-reducing reaction does not take place in said second linear ion trap, and upon condition that said dipole AC electric field, having a frequency of a secular motion of charge-reduced ions by said charge-reducing reaction or having a frequency band including a frequency of a secular motion of said charge-reduced ions, is applied to said first linear ion trap such that said charge-reduced ions excited selectively by said dipole AC electric field are selectively transferred to said second linear ion trap from said first linear ion trap.

4. A charge-reducing method according to claim 3, further comprising the steps of:

deflecting said multiple-charged sample ions by a polarity; and introducing said multiple-charged sample ions into said first and second linear ion traps.

5. A charge-reducing method according to claim 3, further comprising the steps of:

deflecting said opposite-charged ions by a polarity; and introducing said opposite-charged ions into said first linear ion trap.

6. A charge-reducing method according to claim 3, further comprising the steps of:

detecting unwanted ions based on the measured mass spectrum, and eliminating said unwanted ions from said first linear ion trap;

wherein said unwanted ions are eliminated from said first linear ion trap before said charge-reducing reaction.

7. An analyzing apparatus comprising:

a sample ion source which generates multiple-charged sample ions;

first and second linear ion traps arranged in series;

an AC power supply system which supplies a dipole AC electric field to said first linear ion trap;

an opposite-charged ion source which generates opposite-charged ions with respect to said multiple-charged sample ions; and a mass spectrometer which mass analyzes said multiple-charged sample ions;

herein said multiple-charged sample ions are introduced into said first and second linear ion traps, and said multiple-charged sample ions in said first and second linear ion traps lose kinetic energy by collision with a gas filling said first and second linear ion traps;

wherein said multiple-charged sample ions in said second linear ion trap are transferred to said first linear ion trap; and wherein said opposite-charged ions are introduced into said first linear ion trap upon condition that, to said opposite-charged ions, an electrostatic potential of said second linear ion trap is set higher than an electrostatic potential of said first linear ion trap such that said opposite-charged ions are not introduced into said second linear ion trap and a charge-reducing reaction between said opposite-charged ions and said multiple-charged sample ions takes place in said first linear ion trap and said charge-reducing reaction does not take place in said second linear ion trap, and upon condition that said dipole AC electric field, having a frequency of a secular motion of charged-reduced ions by said charge-reducing reaction or having a frequency band including a frequency of secular motion of said charge-reduced ions, is applied to said first linear ion trap by said AC power supply system such that said charge-reduced ions excited selectively by said dipole AC electric field are selectively transferred to said second linear ion trap from said first linear ion trap.

8. An analyzing apparatus according to claim 7, wherein said charge-reduced ions by said charge-reducing reaction are mass analyzed by said mass spectrometer.

9. An analyzing apparatus according to claim 7, wherein said charge-reduced ions excited selectively and transferred selectively to said second linear ion trap from said first linear ion trap are mass analyzed by said mass spectrometer.

10. An analyzing apparatus according to claim 7, wherein said mass spectrometer is a Time of Flight mass spectrometer.

11. An analyzing apparatus according to claim 7, wherein fragment ions generated in said second linear ion trap, by Collision-Induced Dissociation (CID) or Infrared Multi Photon Absorption Dissociation (TRMPD) are mass analyzed by said mass spectrometer.

12. An analyzing apparatus according to claim 7, further comprising:

a quadrupole deflector which deflects ions by a polarity of ions and introduces separately said multiple-charged sample ions and said opposite-charged ions at different times, wherein, at a first time, said multiple-charged sample ions are introduced into said first and second linear ion traps through said quadrupole deflector; and wherein, at a second time, said opposite-charged ions are introduced into said first linear ion trap through said quadrupole deflector.

13. An analyzing method comprising the steps of:

generating multiple-charged sample ions;

introducing and accumulating said multiple-charged ions into a first linear ion trap;

transferring said multiple-charged sample ions accumulated in said first linear ion trap to a second linear ion trap, said first and second linear ion traps being arranged in series;

measuring a mass spectrum of said multiple-charged sample ions accumulated in said second linear ion trap;

estimating a mass and charge of said multiple-charged sample ions, based on said mass spectrum;

transferring said multiple-charged sample ions in said second linear ion trap to said first linear ion trap;

generating opposite-charged ions with respect to said multiple-charged sample ions and introducing said multiple-charged sample ions into said first linear ion trap;

causing a charge-reducing reaction between said opposite-charged ions and said multiple-charged sample ions in said first linear ion trap to obtain charge-reduced ions; and exciting said charge-reduced ions selectively by a dipole AC electric field applied to said first linear ion trap and transferring said charge-reduced ions excited selectively to said second linear ion trap;

wherein said opposite-charged ions are introduced into said first linear ion trap upon condition that, to said opposite-charged ions, an electrostatic potential of said second linear ion trap is set higher than an electrostatic potential of said first linear ion trap such that said opposite-charged ions are not introduced into said second linear ion trap and a charge-reducing reaction between said opposite-charged ions and said multiple-charged sample ions takes place in said first linear ion trap an said charge-reducing reaction does not take place in said second linear ion trap, and upon condition that said dipole AC electric field, having a frequency of a secular motion of charge-reduced ions by said charge-reducing reaction or having a frequency band including a frequency of a secular motion of said charge-reduced ions, is applied to said first linear ion trap by said AC power supply system such that said charge-reduced ions excited selectively by said dipole AC electric field are selectively transferred to said second linear ion trap from said first linear ion trap.

14. An analyzing method according to claim 13, further comprising the steps of:

mass analyzing said charge-reduced ions by said charge-reducing reaction.

15. An analyzing method according to claim 13, further comprising the steps of:

mass analyzing said charge-reduced ions excited selectively and transferred selectively to said second linear ion trap from said first linear ion trap.

16. An analyzing method according to claim 13, further comprising the steps of:

generating fragment ions in said second linear ion trap by Collision-Induced Dissociation (CID) or Infrared Multi Photon Absorption Dissociation (IRMPD); and mass analyzing said fragment ions.

17. An analyzing method according to claim 13, further comprising the steps of:

deflecting said multiple-charged sample ions by a polarity; and introducing said multiple-charged sample ions into said first an second linear ion traps.

18. An analyzing method according to claim 13, further comprising the steps of:

deflecting said opposite-charged ions by a polarity; and introducing said opposite-charged ions into said first linear ion trap.

* * * * *